US007470221B1

(12) United States Patent
Ramos

(10) Patent No.: US 7,470,221 B1
(45) Date of Patent: Dec. 30, 2008

(54) UPPER EXTREMITY PORTABLE EXERCISE MACHINE

(76) Inventor: Ryan Bangoy Ramos, 6343 Manatee Ave. W., Bradenton, FL (US) 34209

( * ) Notice: Subject to any disclaimer, the term of this patent is extended or adjusted under 35 U.S.C. 154(b) by 596 days.

(21) Appl. No.: 11/145,148

(22) Filed: Jun. 3, 2005

(51) Int. Cl.
*A63B 21/06* (2006.01)
*A63B 23/12* (2006.01)

(52) U.S. Cl. ..... 482/100; 482/139; 482/904

(58) Field of Classification Search ..... 482/92–94, 482/97, 99, 100, 102–104, 106, 108, 133, 482/136–140, 904, 98, 101, 49, 50, 79, 80; D21/673, 675–677
See application file for complete search history.

(56) References Cited

U.S. PATENT DOCUMENTS

| | | | | | |
|---|---|---|---|---|---|
| 804,218 | A * | 11/1905 | Fiedler | 482/102 |
| 3,708,167 | A * | 1/1973 | Potgieter | 482/100 |
| 4,169,589 | A * | 10/1979 | McArthur | 482/101 |
| 4,546,967 | A * | 10/1985 | Kecala | 482/145 |
| 4,746,115 | A * | 5/1988 | Lahman | 482/113 |
| 4,757,993 | A * | 7/1988 | Rake | 482/130 |
| 4,763,897 | A * | 8/1988 | Yakata | 482/100 |
| 4,804,179 | A * | 2/1989 | Murphy et al. | 482/97 |
| 5,005,829 | A * | 4/1991 | Caruso | 482/112 |
| 5,048,825 | A * | 9/1991 | Kelly | 482/94 |
| 5,100,128 | A * | 3/1992 | Mabry et al. | 482/134 |
| 5,409,440 | A * | 4/1995 | Yang | 482/138 |
| 7,229,394 | B1 * | 6/2007 | Tyree | 482/137 |
| 2004/0209752 | A1 * | 10/2004 | Thonn, Jr. | 482/140 |

FOREIGN PATENT DOCUMENTS

| | | | |
|---|---|---|---|
| FR | 2545724 | A1 * | 11/1984 |
| FR | 2569349 | A1 * | 2/1986 |
| WO | WO 9014132 | A1 * | 11/1990 |
| WO | WO 9530454 | A1 * | 11/1995 |

* cited by examiner

*Primary Examiner*—Loan H Thanh
*Assistant Examiner*—Victor K Hwang
(74) *Attorney, Agent, or Firm*—Dorothy S. Morse

(57) ABSTRACT

A portable exercise machine for performing upper extremity exercises including seated chest press, seated-row, seated triceps pull down, and modified seated abdominal crunches. It has two adjacent vertical pieces and one opposing taller vertical piece, each attached to a base member. It also has a pivoting member oriented in an operator-selected direction and an adjustable articulated arm bar with holes at various locations for handgrip attachment and adjustment according to operator stature for optimal user comfort during exercises. Mass resistance is secured by a filamentous member to the pivoting member and moved via pulley systems. The portable exercise machine provides functional body alignment and mimics the range of motion and type of movement needed for daily living, in activities such as but not limited to feeding and dressing. Most importantly, the present invention maximizes the productivity and efficiency of the user and the therapist in a rehabilitation setting.

16 Claims, 11 Drawing Sheets

26

16

23
24

15

27

18
19
13
17

UPPER EXTREMITY PORTABLE EXERCISE MACHINE

FIELD OF THE INVENTION

This invention relates generally to the field of resistance type exercise machines, and more particularly to a portable machine for exercising the upper body muscle groups in a wide range of motion.

DESCRIPTION OF THE RELATED ART

Exercise apparatuses have been designed to strengthen particular muscle groups of the body. They are typically expensive multi-station gyms which occupy a large area of floor space. However, as these apparatuses have developed, their size and accessibility have been a constraint to people with physical limitations. For example, people that are obese, amputees, and have undergone total hip replacements, secondary to the hip precautions, are unable to functionally transfer into the seat incorporated into the mechanical structure of the machine and required for its use. In addition, the seats of such exercise machines have little or no trunk support and people with vestibular problems and poor proprioception will have difficulty sitting up in a seat that has a poor trunk support, which increases the chance of the operator falling out of the seat.

One of the challenges in a physical rehabilitation setting is to provide a wide variety of strengthening exercises for a particular muscle group. However, with prior art exercise machines it is difficult to achieve the maximum rehabilitation potential if the intended operator is limited to a sitting position in a wheelchair or other chair. In addition, people with misalignments of trunk, upper and lower extremities will also encounter discomfort from the resistance pulling against the functional joint range of motion. For example, in a wall pulley exercise apparatus the starting range of the upper extremity for a chest press exercise is in a hyper extended position, which increases the chance of joint dislocation. More over, a wall pulley apparatus requires a substantial effort to regulate the resistance level and without proper supervision will cause rope/cable burn. More importantly, the use of a wall pulley apparatus or free weights does not follow a predetermined exercise path which the operable member is unable to isolate and strengthen a specific muscle group. In contrast, the present invention can be used to minimize muscle atrophy in individuals with functional limitation, as well as provide a means for accomplishing progressive resistive exercises. More importantly, the present invention provides strengthening of the muscle groups as well as implementation of the functional range of motion needed to increase the activity of daily living.

BRIEF SUMMARY OF THE INVENTION

One of the objects of the present invention is to provide a compact, portable, and easily accessible exercise machine for performing a variety of upper extremity exercises. Another object of the present invention is to provide functional body alignment and functional range of motion that mimics the range of motion of the type of movement needed for daily living. In addition, yet another object of the present invention is to provide an apparatus for performing a seated chest press, seated row, seated triceps pull down and modified abdominal crunches in an efficient and timely transition of each exercise.

In view of the foregoing disadvantages of prior exercise apparatuses and in contrast thereto, the present invention provides a portable exercise machine with two spaced-apart vertical pieces and one opposing taller vertical piece attached to a base member. A pivoting member that has a first end and a second end, which can be alternated to perform different exercises, is attached between the two shorter vertical pieces by a rod. The first end of a filamentous member is attached to a fastener that adheres to a mass resistance. The second end of the filamentous member is attached to a clamp that removably latches to the concavity of the pivoting member. A pulley is mounted on the base member between the spaced-apart vertical pieces and the opposing taller vertical piece, with two additional pulleys attached in spaced-apart relation to the top portion of the taller vertical piece. During use of the present invention, the filamentous member glides over the pulley members and raises the mass resistance. An L-shaped bracket or primary articulated arm used with the present invention is attached to the second end of the pivoting member by a locking pin that is inserted into a selected operator-selected hole appropriate to the intended exercise to be performed and operator stature. Several different extensions, bars, or other handgrip or handle configurations are then attached to the L-shaped bracket or primary articulated arm, with handle/handgrip/bar/extension selection being determined by the intended exercise to be performed, rehabilitation goals, and operator stature. The L-shaped bracket is adjustable vertically and also permits handle/handgrip/bar/extension adjustment toward and away from the operator's body. The primary articulated arm is adjustable vertically, can be lengthened horizontally, and can be extended towards the operator's body to place an extension, handle, bar, or handgrips in optimum relation to the operator for use during exercise. For example, bilateral handgrips can be laterally attached by clamps at or near the opposed ends of an adjustable T-shaped extension that is secured within the upper end of the L-shaped bracket or primary articulated arm for performing bilateral seated row exercise, as shown in FIG. 7. As a further example and in the alternative, one or more adjustable primary articulated arms can also be attached to the second end of the pivoting member, with a laterally adjustable U-shaped bicycle-type of handle configuration secured to the uppermost end of the articulated arm bar extension or extensions, so as to allow the operator to perform bilateral triceps pull down exercise, as shown in FIG. 11. In addition, to perform seated chest press exercise, a laterally adjustable T-shaped extension/bar can be secured to the upper end of the L-shaped bracket or primary articulated arm, as shown in FIG. 4. This same configuration that can also be used by an operator to perform modified abdominal crunch exercise in a seated position.

Use of the preferred configurations of the present invention to perform a variety of upper extremity exercises is uncomplicated. The seated chest press exercise is performed by placing the present invention in front of the operator in a chair or wheelchair and the operator then gripping the handle/handgrip/bar/extension attached to the operator end of the pivoting member via an L-shaped bracket or the primary articulated arm and pulling the handle/handgrip/bar/extension from a retracted position of the upper extremity to a protracted motion in an isotonic resistance and in a predetermined controlled path. Furthermore, modified abdominal crunch exercise in a seated position is achieved by adjusting and extending the handle/handgrip/bar/extension secured to the L-shaped bracket or primary articulated arm into a position near the chest area of the operator. As the operator secures the handle/handgrip/bar/extension with his/her grip in a supinated forearm position, the operator then crunches forward by contracting and strengthening the abdominal muscles. The configuration of the present invention for such exercise is visible in FIG. 4. Additionally, the seated row exercise is performed with the present invention by the operator gripping the handle/handgrip/bar/extension and moving it from a protracted position of the upper extremity to a retracted motion in an isotonic resistance and in a predetermined controlled path. The configuration of the present invention for such exercise is visible in FIGS. 6 and 7. Further, the seated triceps pull down exercise is performed unilaterally by positioning the present invention beside a wheelchair or chair with the chair occupant gripping the second end of the pivoting arm member from an elbow flexion position to an elbow extension motion in an isotonic resistance and in a predetermined controlled path. The configuration of the present invention for such exercise is visible in FIG. 1. Also, adding an articulated arm and one or more handle/handgrip/bar/extension, as shown in FIGS. 10 and 11, allows the user to perform bilateral triceps pull down exercise. The present invention is positioned in front of the operator, with the operator then bilaterally gripping the handle/handgrip/bar/extension from an elbow flexion position to an elbow extension motion. The configuration of the present invention for such exercise is visible in FIG. 11.

Most importantly, in accordance with the statements above, the present invention is a portable device that can break down for convenient storage and/or transport, and allows the performance of a variety of exercises that mimic the functional range of motion required for a person to successfully conduct the activities of daily living, while most prior art devices are not as versatile. For example, when getting up from a wheelchair or a chair a person has to use mainly the triceps and shoulder depressor muscles. The starting position is elbow flexion and then he/she pushes up from the arm chair fully extending the triceps muscle and elbow joint. The seated triceps pull down using the present invention strengthens the group of muscles that mimics this motion. Another example of the present invention mimicking the functional range of motion required for daily living relates to the propelling of a wheelchair, where a person has to use mainly chest, triceps, biceps, and latissimus dorsi muscles. The starting position is elbow flexion and the bilateral upper extremities are in a retracted position. As he/she propels the wheelchair wheels forward, the end position of the bilateral upper extremities are in a protracted position and the elbow in full extension. The present invention strengthens the group of muscles that are used to propel a wheelchair. Other functional activities of daily living that the present invention mimics, while not limited thereto, are the motions of opening and closing a door, feeding, dressing, and the pulling on and removal of pants.

BRIEF DESCRIPTION OF THE DRAWINGS

The invention shall now be described with reference to the accompanying drawings, which show and disclose one non-limiting preferred embodiment.

DESCRIPTION OF THE PREFERRED EMBODIMENTS

Figure 1:
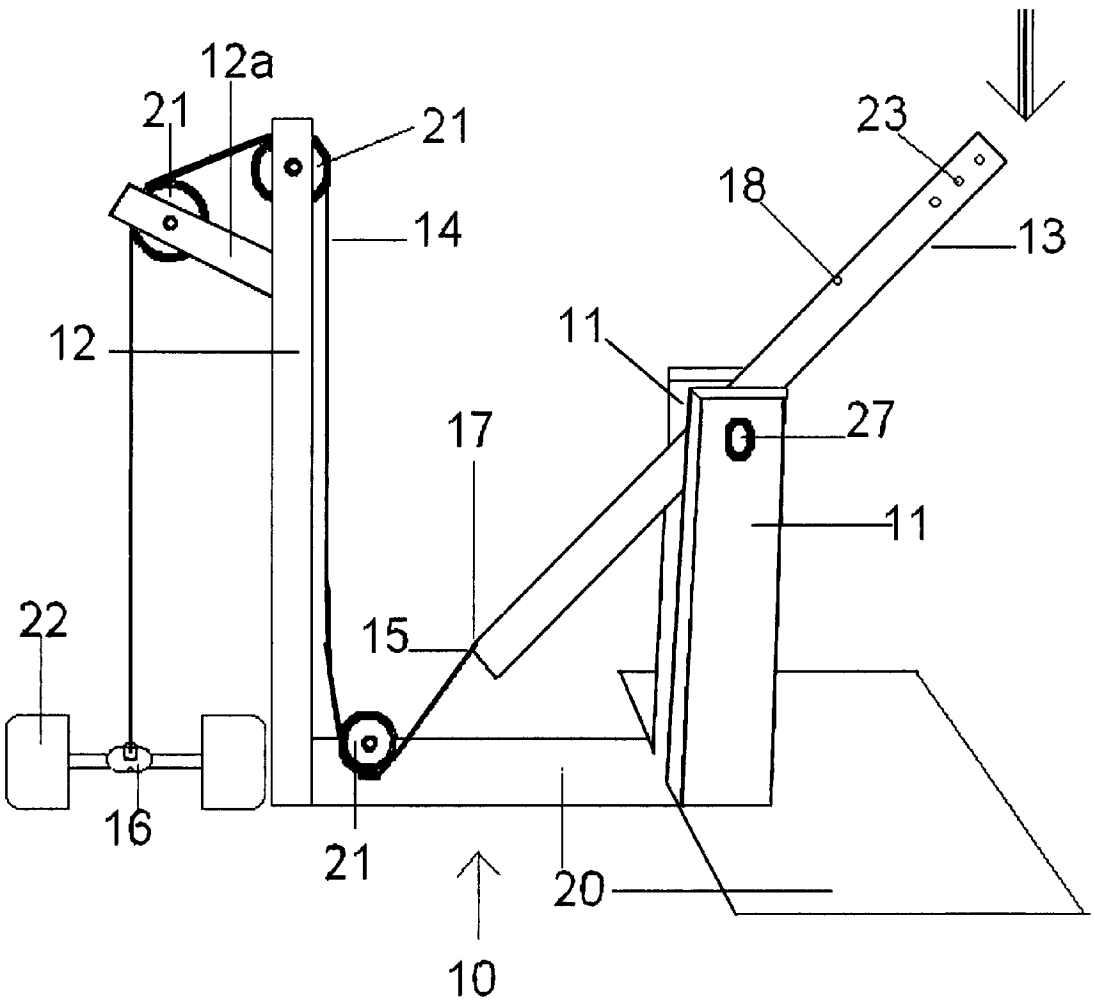
FIG. 1 is a side perspective view of the most preferred embodiment of a machine according to the present invention set up for unilateral triceps pull down exercise, with the three line body arrow on the upper right side representing the operator applied force.

In FIG. 1, the number 10 includes, in the entirety, a portable machine for exercising the upper body muscle groups in a wide range of motion. Preferably, although not shown, the present invention has rounded corners and blunt edges to address safety issues. Also, it is to be understood that the brackets/arms/attachments/handles/handgrips/bars/extensions which can be used with the pivoting member 13 of the present invention to adapt it for differing upper extremity exercises are not limited to those shown in the accompanying drawings. Further, to facilitate transport and storage, pivoting member 13 is separable from the two vertical pieces 11 and mass resistance 22 can be separated via fastener 16 from filamentous member 14. In addition, although some preferred embodiments have vertical pieces 11 and 12 welded to base member 20, vertical pieces 11 and 12 can also be made to be separable from base member 20. As can be seen in the accompanying illustrations, pivoting member 13 is long and slender with a small width in proportion to its length.

Figures 3A, 3B, 3C, 3D, 3E, 3F:
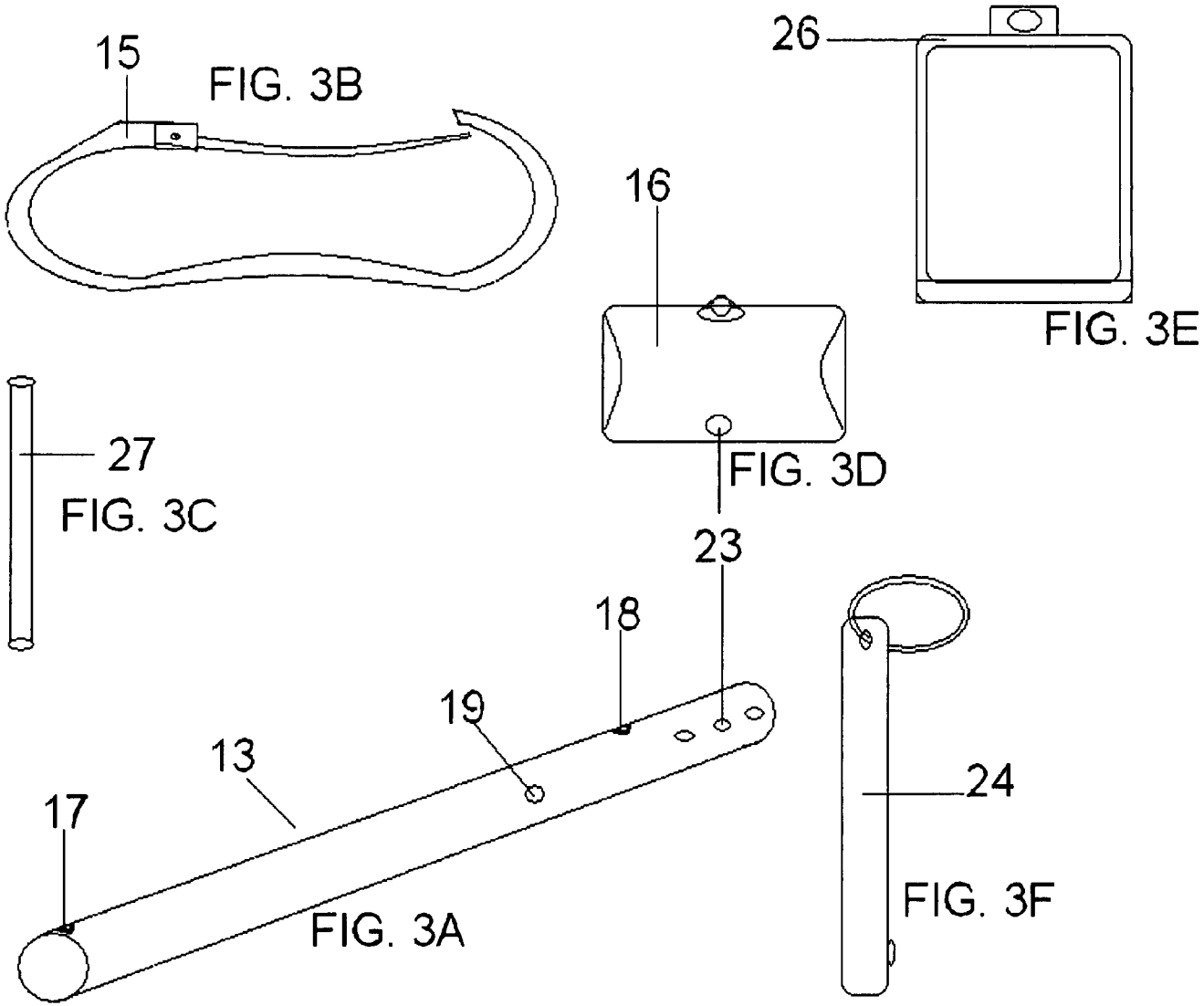
FIG. 3A is a schematic perspective view in an enlarged scale of the pivoting member used in the most preferred embodiment of the present invention, which is also shown in FIG. 1.
FIG. 3B is a schematic perspective view in an enlarged scale of the clamp used in the most preferred embodiment of the present invention, which is also shown in FIG. 2.
FIG. 3C is a schematic perspective view in an enlarged scale of the rod used in the most preferred embodiment of the present invention to anchor the pivoting member for rotation, which is also shown in FIG. 1.
FIG. 3D is a schematic perspective view in an enlarged scale of the fastener used in the most preferred embodiment of the present invention for attachment of the mass resistance to the filamentous member, which is also shown in FIG. 1.
FIG. 3E is a schematic perspective view in an enlarged scale of the handgrip used in the most preferred embodiment of the present invention, which is also shown in FIGS. 7 and 8.
FIG. 3F is a schematic perspective view in an enlarged scale of the locking pin used in the most preferred embodiment of the present invention to rigidly secure the articulated arm bars and extensions to the pivoting member, and which is also shown in FIGS. 5A and 7.

With reference to FIG. 1, machine 10 comprises two spaced-apart and substantially parallel vertical pieces 11 each of which is attached on its lower end to a base member 20, and an opposing taller vertical piece 12 the lower end of which is also supported rigidly by the base member 20. Preferably, although not limited thereto, the vertical pieces 11 and 12 are made from steel and welded securely onto a base member 20 that is also made from steel for strength and durability. Although the preferred configurations and relative dimensions of vertical pieces 11 and 12 are shown in FIG. 1, other configurations and dimensions are also considered to be within the scope of the present invention. A pivoting member 13 is centrally mounted for rotational movement relative to vertical pieces 11 and can be tubular or have any cross-sectional dimension that will allow it to fulfill its intended function. As shown in FIG. 3, pivoting member 13 has a pivoting axis 19 that is located between the two concavities 17 and 18. The length of pivoting member 13 must be sufficiently short so that it does not contact vertical piece 12 during operator exercise. FIGS. 1 and 3 show several holes 23 are located between concavity 18 and the end of pivoting member 13 that is most adjacent to concavity 18, which allow the locking pin 24 to be inserted and rigidly support the L-shaped bracket 28, articulated arm 29, and/or handle/handgrip/bar/extension 25, 26, 30, 31, or 32 that are visible in FIGS. 4-8 and 10-11. FIG. 1 also shows pivoting member 13 attached between the two spaced-apart vertical pieces 11 by a rod 27, the configuration of which is shown in more detail in FIG. 3C.

FIG. 1 further shows an elongated filamentous member 14 with opposing ends. For some exercises, filamentous member 14 is attached to cavity 17, and for other exercises filamentous member 14 is attached to cavity 18. While it is preferred for filamentous member 14 to be a cable or rope, it is not limited thereto and the materials from which filamentous member 14 is made can be any material or combination of materials that can support the mass resistance and fulfill its intended function. The first end of the filamentous member 14 is attached to a fastener 16 that secures filamentous member 14 to the mass resistance 22. Fastener 16 should also provide a strong and secure grip on mass resistance 22, and more than one fastener 16 can be used. Further, each fastener 16 used can also be easily releasable for rapid substitution of one mass resistance 22 by another of a different weight, or in the alternative, fasteners 16 can be non-releasable with the mass resistance 22 being configured for easily adjustable weight variability. In addition, the configuration for fastener 16 shown in FIG. 1 is preferred, but not critical. The second end of the filamentous member 14 is attached to a clamp 15, not visible in FIG. 1 but readily visible in FIG. 2, that is configured to latch filamentous member 14 to the concavity 17 of the pivoting member 13. FIG. 1 also shows several pulleys 21 that are used to guide the movement of filamentous member 14 during operator exercise. One pulley is mounted upon base member 20 between vertical pieces 11 and 12, while FIG. 1 shows a second pulley 21 mounted to the top end of vertical piece 12 and a third pulley secured by a support member 12*a* to vertical piece 12 in a position remote from vertical pieces 11. Although three pulleys 21 are preferred, the size and number are not critical and can vary from that shown in FIG. 1. FIG. 1 is set up for unilateral triceps pull down exercise and shown in its pre-exercise position, with the three line body arrow on the upper right side representing the operator applied force needed to initiate movement of mass resistance 22.

Figure 2:
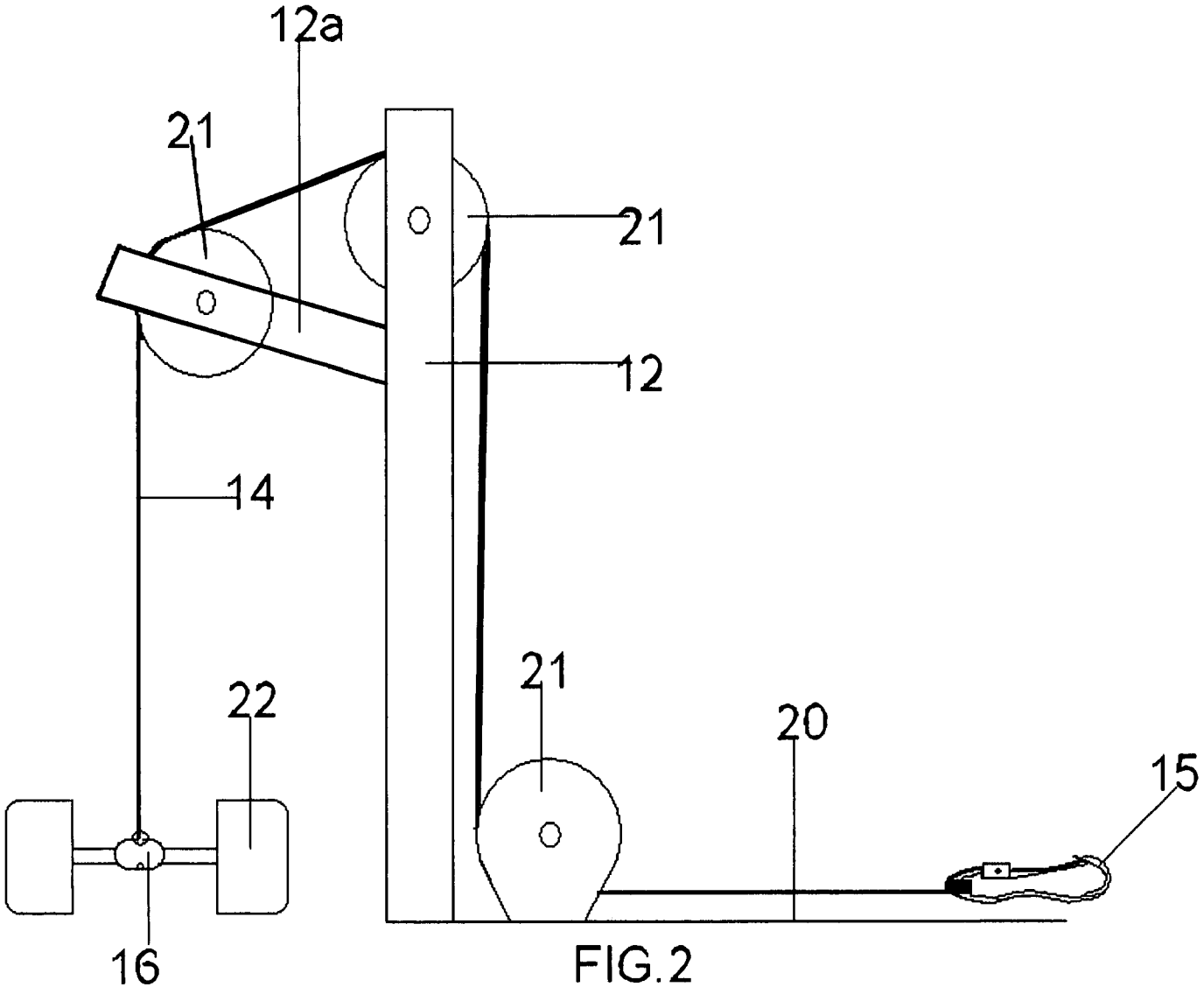
FIG. 2 is an enlarged perspective view of the left side of the preferred embodiment of the present invention, also shown in FIG. 1, with the clamp on the end of the filamentous member visible.

With reference to FIG. 2, filamentous member 14, vertical piece 12, and pulleys 21 are shown without pivoting member 13, vertical pieces 11, or base member 20. Thus, the clamp 15 on the end of filamentous member 14 remote from mass resistance 22 is visible. As in FIG. 1, three pulleys 21 are shown, all shown in close association with vertical piece 12. One pulley 21 is secured in a fixed position adjacent to the lower end of vertical piece 12 and on the side of vertical piece 12 that is remote from mass resistance 21. A second pulley 21 is secured to the top end of vertical piece 12, with a third pulley 21 being fixed by a support member 12*a* in a position that allows a portion of filamentous member 14 to extend directly downward to mass resistance 22 and provide a connection between mass resistance 22 and pivoting member 13, with filamentous member 14 being used to raise mass resistance 22 in response to an operator applying force to the end of pivoting member 13 not connected to filamentous member 14. Although FIG. 2 shows the second pulley 21 not being mounted to the top of vertical piece 12, such top mounting is a contemplated option. Also, the length of support member 12*a*, the size of pulleys 21, and the connection of the third pulley 21 to support member 12*a* can be different from that shown in FIG. 2. Conventional pulleys with a variety of dimensions can be used as pulleys 21 in the present invention, as long as they facilitate and guide the movement of filamentous member 14 while it lifts mass resistance 22 during operator exercise. Although not limited thereto, for the attachment of the second and third pulleys 21 that guide the movement of filamentous member 14 over the top of the taller vertical piece 12, support member 12*a* is fixed at an angle of approximately 60 degrees relative to vertical piece 12 to place the third pulley 21 in an inferior position to the second pulley 21 that is directly attached to vertical piece 12. As operator exercise begins, the center portion of the filamentous member 14 glides over the three pulleys 21 and moves toward pivoting member 13, while at the same time lifting mass resistance 22. As operator exercise continues, the center portion of the filamentous member 14 alternatively reverses position as it glides over the three pulleys 21 to alternatively raise and lower mass resistance 22. Mass resistance 22 is provided by conventional means, such as but not limited to a dumbbell or any weight stack that will allow the present invention to fulfill its intended function.

FIGS. 3A to 3F respectively show the pivoting member 13, clamp 15, rod 27, fastener 16, handgrip 26, and locking pin 24 used in the most preferred embodiment of the present invention. FIG. 3A shows pivoting member 13 having a pivoting axis 19 that is located between the two concavities 17 and 18. FIG. 3 also shows pivoting member 13 having several holes 23 are located between concavity 18 and the end of pivoting member 13 that is most adjacent to concavity 18, which allow the locking pin 24 to be inserted therein and rigidly support the L-shaped bracket 28, articulated arm 29, and/or handle/handgrip/bar/extension 25, 26, 30, 31, or 32 that are visible in FIGS. 4-8 and 10-11. Pivoting member 13 is mounted for rotational movement relative to vertical pieces 11 so that for some operator exercises concavity 17 is adjacent to vertical piece 12 and for other exercises concavity 17 is positioned remotely from vertical piece 12. Although FIG. 3A shows pivoting member 13 having a tubular configuration, it may also have any cross-sectional configuration or dimension that will allow it to fulfill its intended function. Also, the length of pivoting member 13 must be in proportion to the distance between vertical pieces 11 and vertical piece 12 so that pivoting member 13 does not contact vertical piece 12 during operator exercise. With reference to FIG. 3B, one example of a clamp 15 is provided that can be used in the most preferred embodiment of the present invention between the end of filamentous member 14 remote from mass resistance 22 and pivoting member 13. Although FIG. 3B shows clamp 15 in the form of a closed loop, other configurations of fastener or clamp having a locking type of mechanism are also contemplated. It is preferred for clamp 15 to be constructed of steel, thereby providing sturdy construction, however other sturdy materials are also contemplated. FIG. 3C shows the rod 27 used in the most preferred embodiment of the present invention to anchor the pivoting member 13 to vertical pieces 11 for rotation. The cylindrical configuration shown for rod 27 is preferred for most effective and efficient rotation of pivoting member 13. In addition, in reference to FIG. 3D, a fastener 16 that is used to support the mass resistance 22 is shown in the form of a sleeve with at least one hole 23 centrally therethrough. Fastener 16 can be constructed of flexible metal and is configured to centrally hold mass resistance 22 in a balanced manner. When mass resistance 22 is in the form of a dumbbell, fastener 16 securely embraces the body of the dumbbell configuration, locking it into position through use of a locking pin, such as that shown in FIG. 3F by the number 24 through a hole 23. The locking pin 24 has a ring at one end for use by an operator to pull locking pin out of the associated hole 23. A springy or positively biased protuberance (visible but not identified by a number in FIG. 3F) on the other end of locking pin 24 remote from its ring assures that locking pin 24 stays in its targeted hole 23 until deliberately released. FIG. 3E shows the configuration of handgrip 26 that is used in the most preferred embodiment of the present invention and shown in FIG. 7 attached to the ends 32 of articulated arm bar extension 25. Although it is preferred for handgrips 26 to be made from durable and resilient material, and be configured for comfort in an operator's hand, their configuration and the materials from which they are made are not critical.

Figure 4:
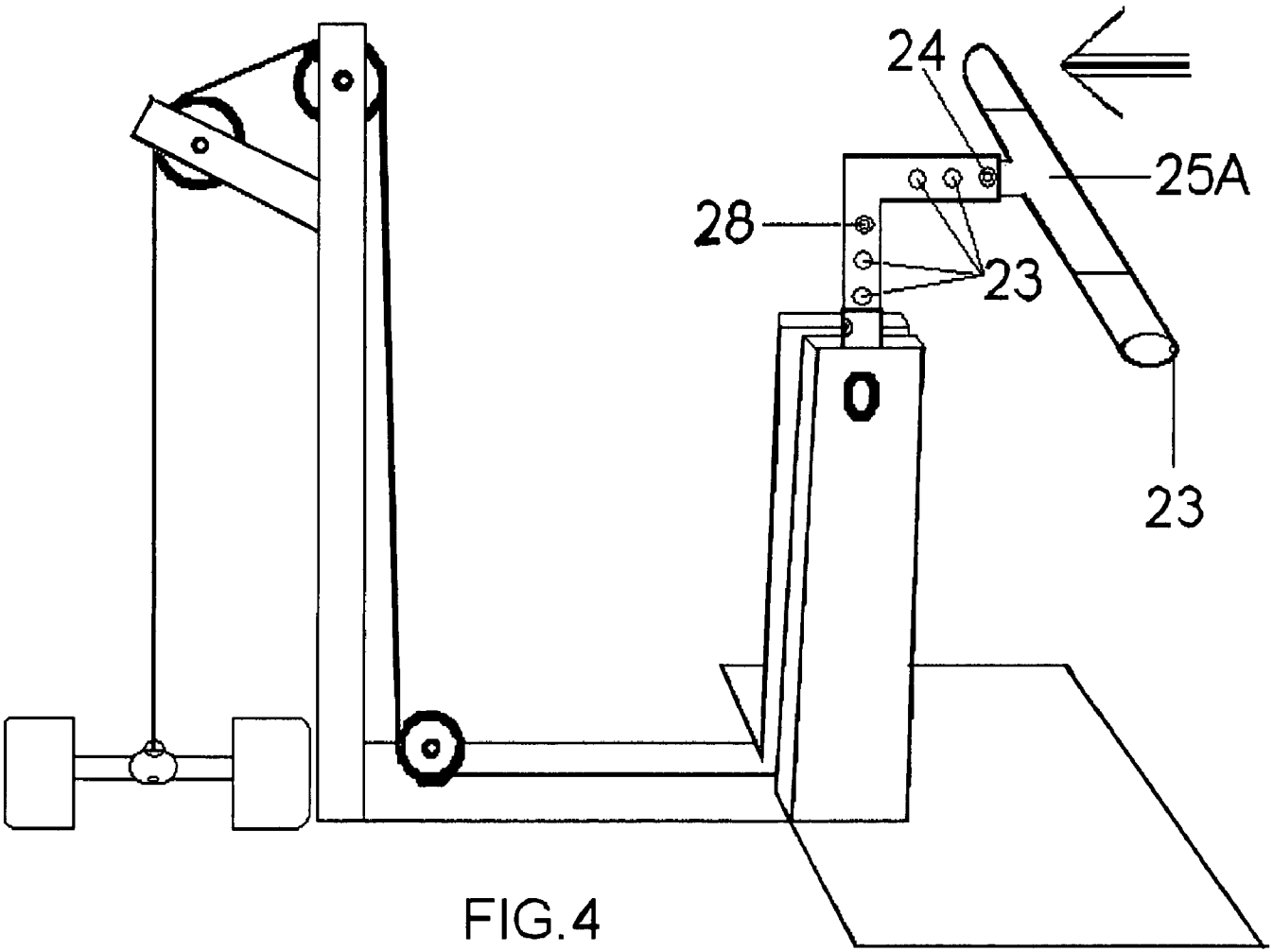
FIG. 4 is a schematic perspective view of a preferred embodiment of the present invention as it appears with an L-shaped bracket and T-shaped extension for chest press and modified seated abdominal crunches exercise with the three line body arrow on the upper right side representing the direction of operator applied force needed to move the mass resistance.

FIG. 4 shows the L-shaped bracket 28 attached to one end of pivoting member 13 so that an operator can perform chest press exercise and modified seated abdominal crunch exercise from an independent chair or wheelchair (not shown). Although a T-shaped bar or extension 25 is connected to the distal end of L-shaped bracket 28 with a locking pin 24 inserted through holes 23 in both L-shaped bracket 28 and extension 25, extensions 25 with configurations other than that shown as 25 may also be used. While the number of holes 23 used in L-shaped bracket 28 and extension 25 is not critical, holes 23 permit upward adjustability of L-shaped bracket 28 and outward adjustability of extension 25 according to operator stature and rehabilitative need. FIG. 4 further shows a lateral hole 23 within the portion of extension portion 25 that would be facing an operator and which can be used to attach handgrips 26 or other means for the operator to use in lifting mass resistance 22 via filamentous member 14. The three line body arrow on the upper right side of the illustration represents the direction of operator applied force needed to move mass resistance 22. As shown in FIG. 4, the present invention is in a pre-exercise condition with mass resistance 22 positioned upon the same surface supporting base member 20. Modified abdominal seated crunches are accomplished with the extension 25 extended towards the operator's chest area. As the user secures the extension 25 with his/her grip in a supinated forearm position, the operator then crunches forward by contracting and strengthening the abdominal muscles.

Figure 5B:
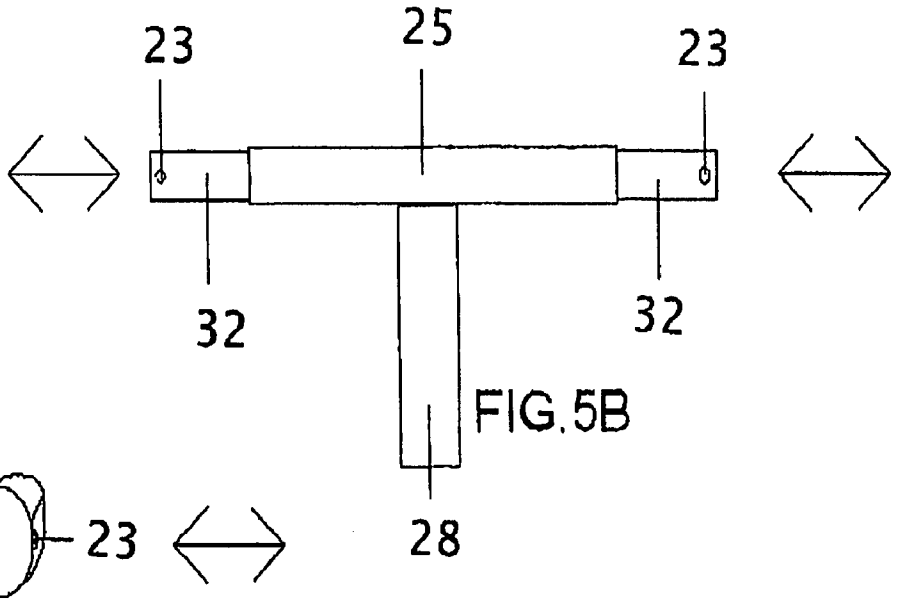
FIG. 5B is a frontal view in an enlarged scale section of a first primary articulated arm or L-shaped bracket extension in the most preferred embodiment of the present invention shown in FIG. 4, with the two double sided arrows representing the directions in which it is adjustable.
Figure 5A:
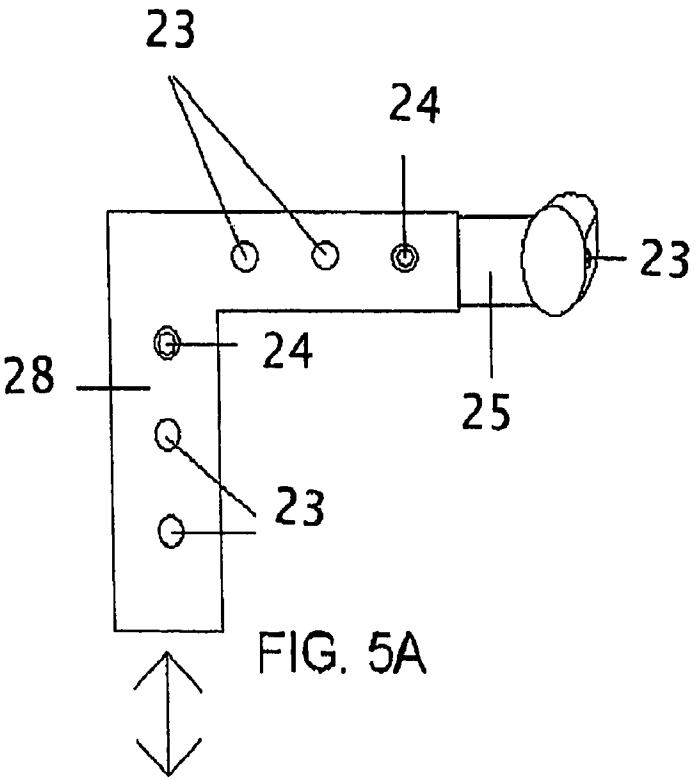
FIG. 5A is a side view in an enlarged scale section of the L-shaped bracket in the most preferred embodiment of the present invention with the two double sided arrows representing the directions in which it is adjustable.

With reference to FIGS. 5A & 5B, FIG. 5A shows L-shaped bracket 28 having holes 23 that adjustment according to operator stature and comfort, with the vertically oriented double-sided arrow showing the vertical direction of its adjustment relative to pivoting member 13. The height of the L-shaped bracket 28 can be raised or lowered by inserting a locking pin 24 into a selected one of the holes 23 in its L-shaped tubular structure and also inserting the same locking pin 24 into a corresponding selected hole 23 in pivoting member 13. Also, in FIG. 5A, the extension 25 shown in FIG. 5B is inserted and secured into the upper end of L-shaped bracket 28 by a second locking pin 24. As indicated by the horizontally oriented double-sided arrow, extension 25 can be lengthened horizontally relative to L-shaped bracket 28 to move extension portion 25 towards the operator's body or retract extension portion 25 further within the L-shaped bracket 28 to shorten the distance between extension portion 25 and the operator's body. In FIG. 5A, extension portion 25 is in an intermediate position, while in FIG. 5B, extension portion 25 is shown in a fully retracted position. FIGS. 5A and 5B further show lateral holes 23 within the portion of extension portion 25 that would be facing an operator and which can be used to attach handgrips 26 or other means for the operator to use in lifting mass resistance 22 via filamentous member 14. In addition, FIG. 5B has two double-sided arrows showing the outward adjustability of extending ends 32 relative to opposed distal ends of extension 25. The means by which the length of extending ends 32 are fixed relative to extension 25 is not critical. The usable positions of L-shaped bracket 28 and extension 25 can be established by a locking pin 24, or any other means that can be used to accomplish the same purpose and is capable of being inserted through a hole 23 in L-shaped bracket 28 and a corresponding receiving hole 23 in either pivoting member 13 or extension 25. Although in FIGS. 5A and 5B the holes 23 in extension 25 are all hidden within L-shaped bracket 28, it is preferred that they are similar in size and configuration to the holes 23 in L-shaped bracket 28 that are visible in FIG. 5A. Preferably, the L-shaped bracket 28 is tubular, although any cross sectional configuration that will allow it to fulfill its intended function is also contemplated. Further, although the angular and substantially L-shaped configuration shown for bracket 28 is preferred, it is not critical and for special applications or design considerations a different configuration can be used.

Figure 6:
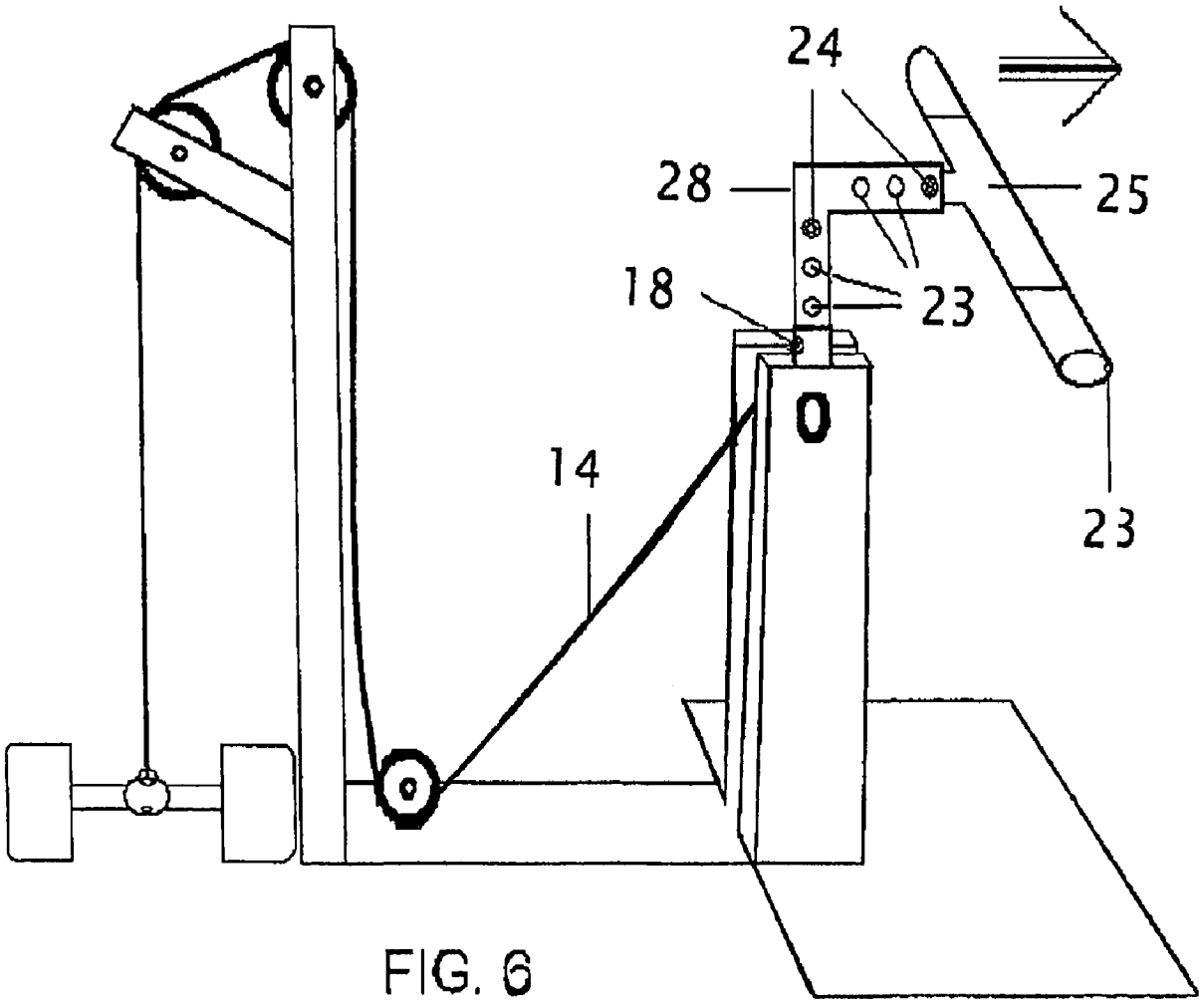
FIG. 6 is a schematic perspective view of the most preferred embodiment of the present invention as it appears for demonstrating seated rowing exercise with the three line body arrow on the upper right side representing the operator applied force.

FIG. 6 shows the most preferred embodiment of the present invention as it appears for demonstrating seated rowing exercise with the three line body arrow on the upper right side representing the direction of operator applied force to initially move mass resistance 22. In contrast to the end of filamentous member 14 remote from mass resistance 22 being secured via clamp 15 to the concavity 17 on pivoting member 13, the end of filamentous member 14 remote from mass resistance 22 is secured via clamp 15 to the concavity 18 on pivoting member 13. L-shaped bracket 28, extension 25, and pivoting member 13 are used for transferring the operator applied force to filamentous member 14, which then causes mass resistance 22 to be raised and lowered. Although FIG. 6 shows the mass resistance (identified by the number 22 in FIG. 1) as a dumbbell, other configurations and dimensions are also considered to be within the scope of the present invention. FIG. 6 further shows a lateral hole 23 within the portion of extension portion 25 that would be facing an operator and which can be used to attach handgrips 26 or other means for the operator to use in lifting mass resistance 22 via filamentous member 14.

Figure 7:
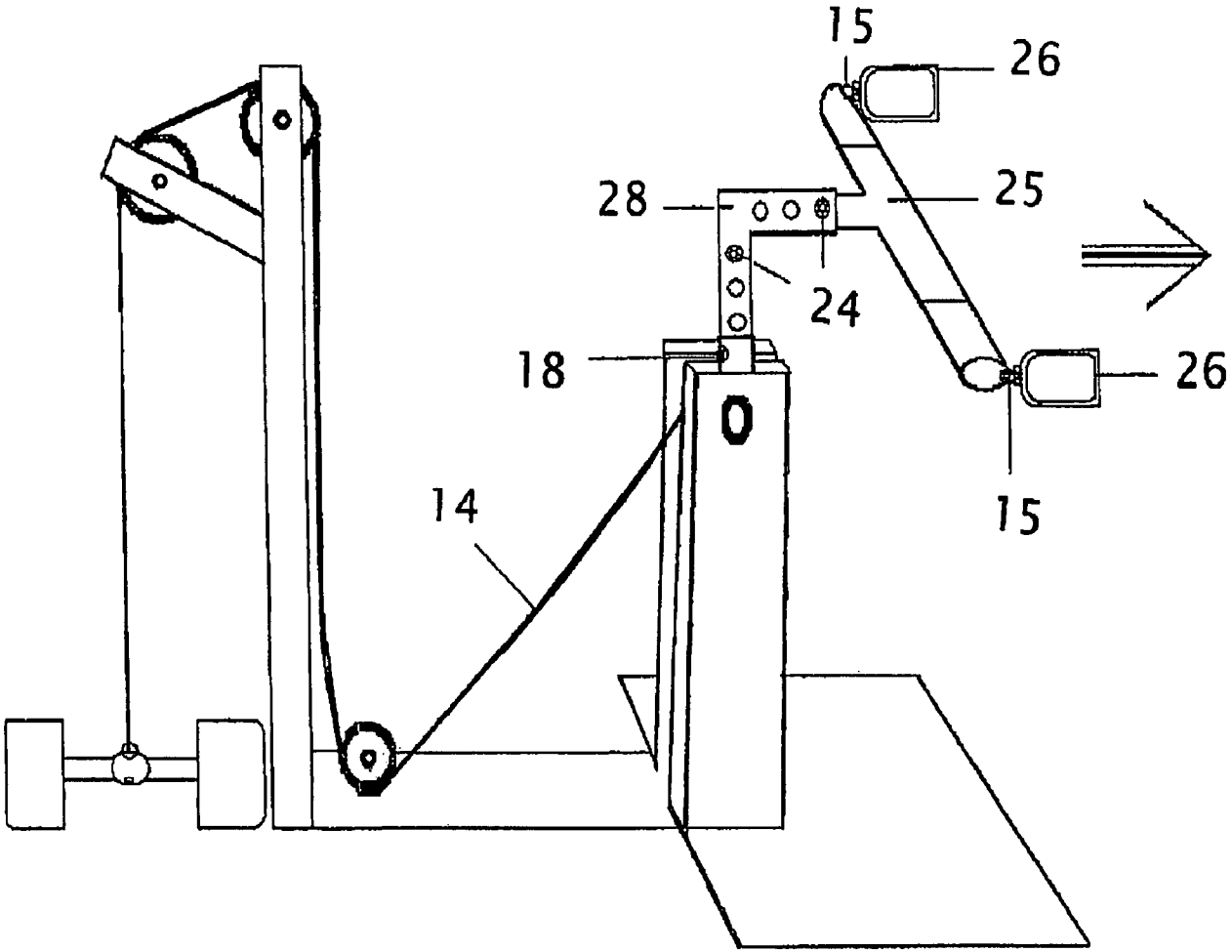
FIG. 7 is a schematic perspective view of the most preferred embodiment of the present invention as it appears with bilateral handgrips for demonstrating seated rowing exercise with the three line body arrow on the right side representing the operator applied force.
Figure 8:
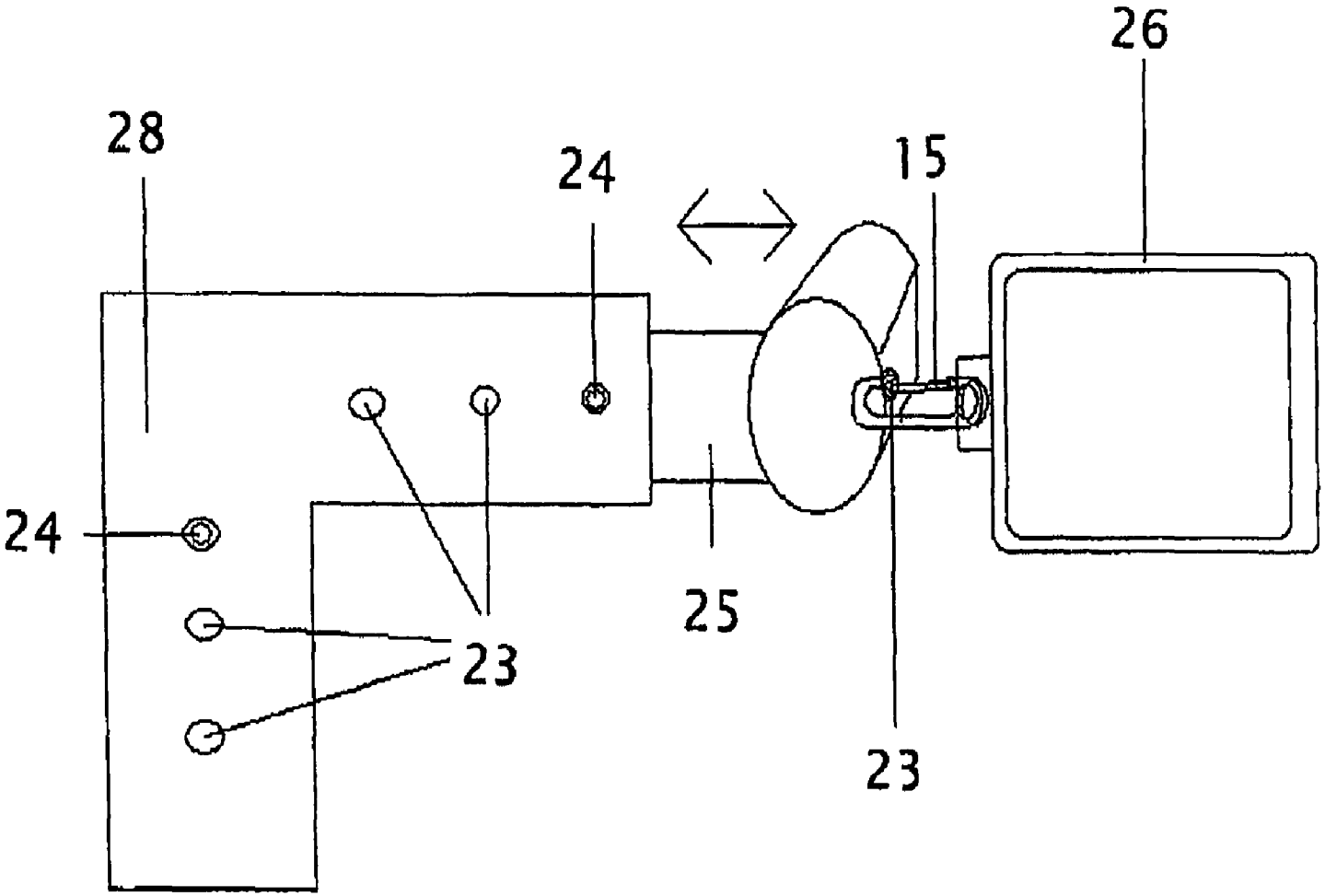
FIG. 8 is an enlarged scale of the handgrip attachment in the most preferred embodiment of the present invention shown in FIG. 7 with the double sided arrow representing the directions in which it is adjustable.

With reference to FIG. 7, bilateral handgrips 26 are attached to the holes 23 in the opposing ends of extension 25. Although FIG. 7 shows use of a clamp 15 for the attachment of handgrips 26 to extension 25, the use of clamps 15 is not critical and other means of secure and/or locking attachment are also contemplated. Preferably, the handgrips 26 are removable, and made from foam rubber or other suitable material which provides cushioning and a non-slip surface for the operator. FIG. 8 is an enlarged scale section that views a handgrip 26 attached to one end of extension 25 via a clamp 15 that connected through a lateral hole 23. Although the configuration of clamp 15 is not critical, it should have a locking configuration. FIG. 8 also shows extension 25 connected via a locking pin 24 to L-shaped bracket 28 via one of several horizontally extending spaced-apart holes 23, and a locking pin 24 inserted through one of several vertically extending spaced-apart holes 23 for connection of the adjacent end of L-shaped bracket 28 to pivoting member 13, as shown in FIG. 7.

Figure 9:
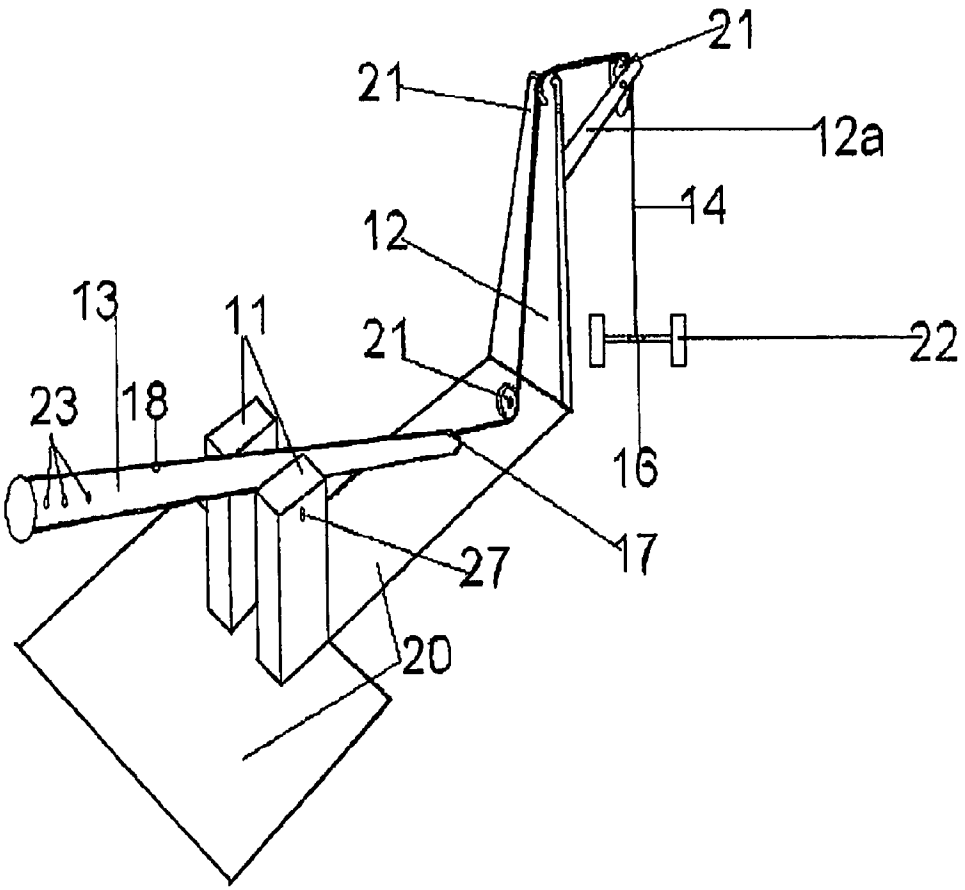
FIG. 9 is a top perspective view of the most preferred embodiment of the present invention.

With reference to FIG. 9, the filamentous member 14, is attached to the concavity 17 of the pivoting arm 13. The present invention is situated at the side of the wheelchair or chair (not shown) so that the operator sitting thereupon can perform unilateral triceps pull down exercise. When the operator grips pivoting arm 13 and applies force in a flexed elbow position and then applies force by extending the elbow joint using the triceps muscles, the triceps pull down exercise is accomplished. The lower end of the two vertical pieces 11 are preferably welded to the top of base member 20, with base member 20 being shaped to accommodate the positioning of the wheelchair front wheels or a chair (not shown) for added stability of the present invention.

Figure 10A:
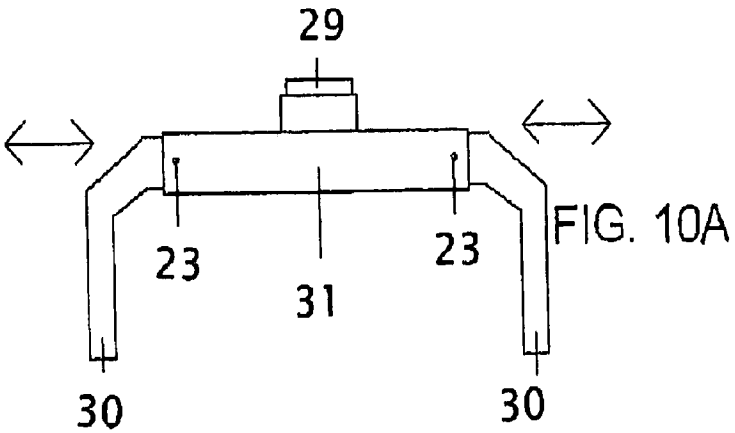
FIG. 10A is a top view in an enlarged scale section of a preferred U-shaped bilateral handle configuration used as a part of the most preferred embodiment of the present invention shown in FIG. 11, with two double sided arrows representing the directions in which it is adjustable.
Figure 10B:
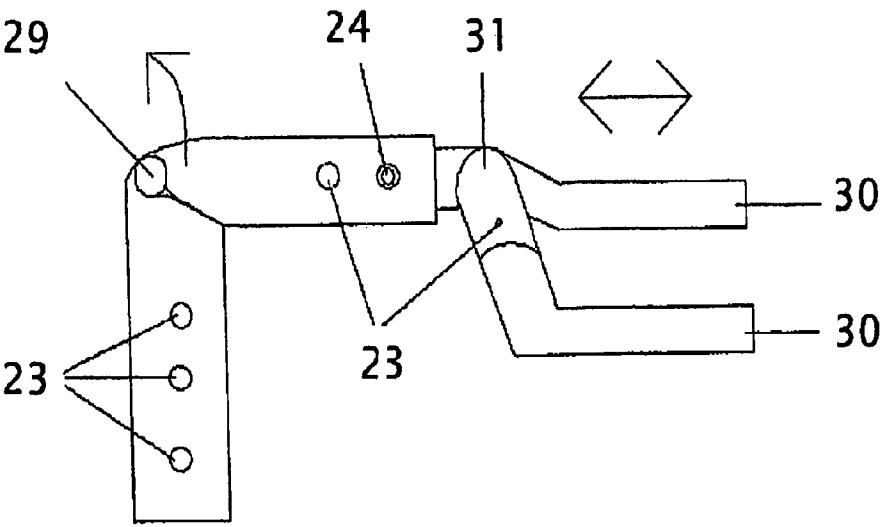
FIG. 10B is a side view in an enlarged scale section of the preferred L-shaped bracket and preferred U-shaped bilateral handle configuration shown in FIG. 11 and used as a part in the most preferred embodiment of the present invention, with the single sided upwardly-directed arrow on the left side representing the hinge joint vertical motion in the articulated arm bar and the double sided arrow representing the directions of adjustability of the extension relative to the articulated arm bar.
Figure 11:
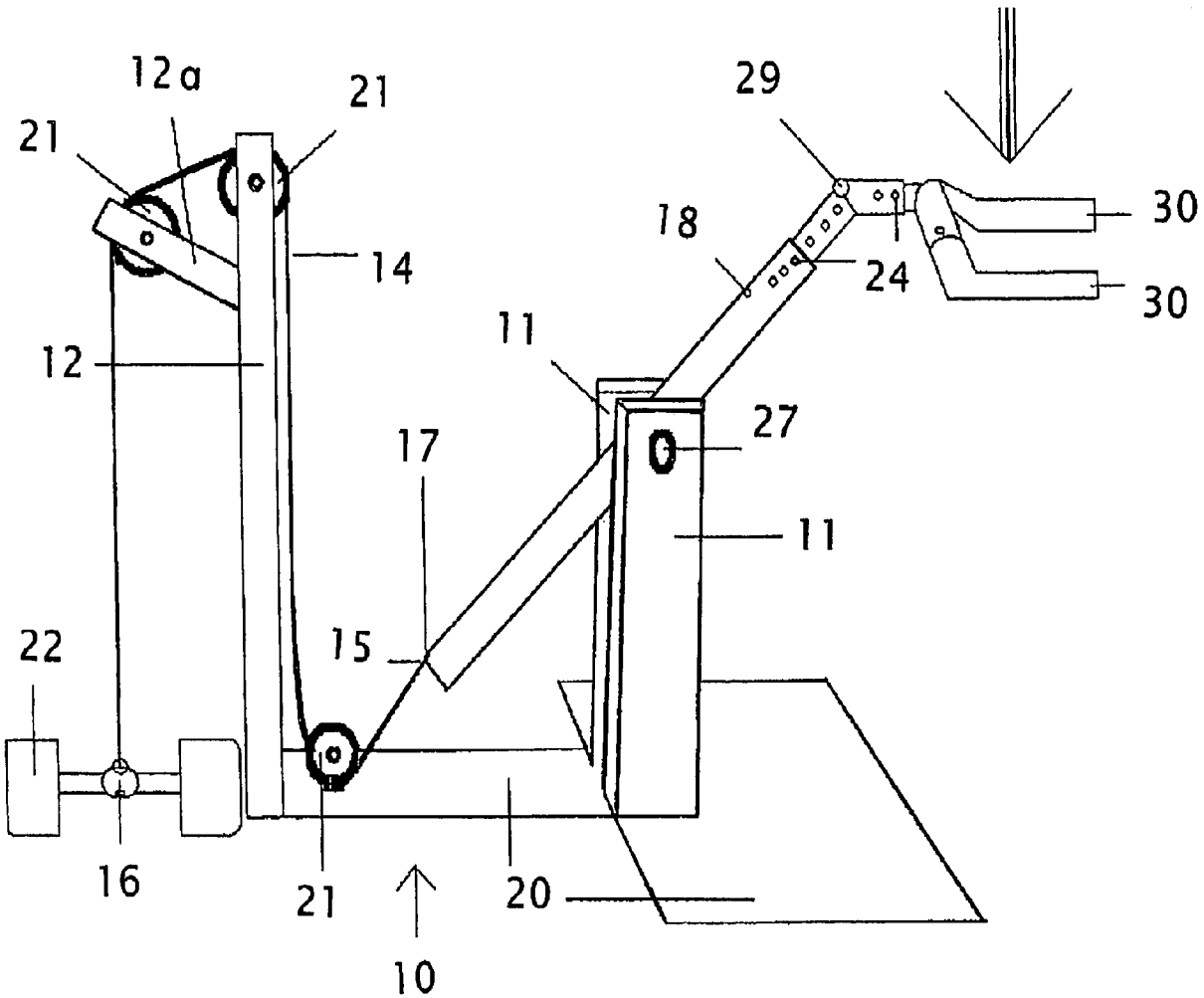
FIG. 11 is a schematic perspective view of the most preferred embodiment of the present invention as is appears for demonstrating seated bilateral triceps pull down with the three line body arrow on the upper right side representing the operator applied force.

More over, with reference to FIGS. 10A, 10B, and 11, an alternate articulated arm bar 29 is shown, which is typically contemplated for attachment to the operator end of pivoting member 13 in place of L-shaped bracket 28. An alternate extension 31 is also shown in FIGS. 10A, 10B, and 11 attached to articulated arm 29, with horizontally-extending and substantially parallel integrated grips 30 outwardly extending toward the operator. To use the present invention with alternate articulated arm bar 29 and alternate extension 31 in place, the present invention is placed in front of the operator so that he/she can perform the bilateral triceps pull down exercise. Bilateral triceps pull down is accomplished by attaching the alternate articulated arm bar 29 to the pivoting arm 13 by use of a locking pin 24 and the operator bilaterally gripping the grips 30 integrated into alternate extension 31 and moving integrated grips 30 from an elbow flexion position to an elbow extension motion. The articulated arm 29 is preferably a hinge joint that limits its angle to approximately 90 degrees when vertical force is applied. The three line body arrow on the upper right side represents the direction of operator applied force needed to initiate movement of mass resistance 22.

Preferably, the present invention is constructed of steel, aluminum alloys, and industrial strength plastics, but is not limited thereto, and it is contemplated for any materials to be used that will allow it to fulfill its intended function. More importantly, in the descriptions mentioned above, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details. In other instances, detailed descriptions of well known mechanical elements are omitted so as to not obscure the description of the present invention with unnecessary detail. Thus, one should look for the definition of the present invention in the claims and not limit it to the examples provided in the accompanying text and illustrations.

I claim:

1. A portable exercise machine adapted for performing upper extremity exercise, said machine comprising:

two adjacent vertical pieces;

an opposing taller vertical piece positioned at a spaced-apart distance from said adjacent vertical pieces;

base member means adapted to support said adjacent vertical pieces and said opposing taller vertical piece, said base member means in contact with said adjacent vertical pieces and said taller vertical piece;

pivoting means movably connected to said adjacent vertical pieces for central positioning over said base member means, said pivoting means comprising a long and slender pivot member having an operator end, configured for engagement by an operator during exercise, an opposed mass resistance end, and a central rotatable connection therebetween to said adjacent vertical pieces;

at least one attachment selectively securable to said operator end, said at least one attachment adapted for further engagement by an operator for performing exercise;

mass resistance means positioned remotely from said pivoting means so that said taller vertical piece becomes located between said mass resistance means and said pivoting means;

elongated flexible means connected between said mass resistance means and said pivoting means;

a plurality of pulleys secured to said taller vertical piece and one pulley secured to said base member means, said pulleys being configured and positioned to collectively guide movement of said elongated flexible means over said taller vertical piece as an operator applies sufficient force to said operator end of said pivoting means to lift said mass resistance means; and at least one fastener connected to said elongated flexible means, said at least one fastener configured to provide an easily releasable attachment with said pivoting member, and wherein said pivoting member comprises connecting means on said operator end and said mass resistance end each configured for attachment with said at least one fastener so that the operator is able to use said at least one fastener to connect said mass resistance means to said operator end of said pivoting means to perform selected upper extremity exercises and thereafter use said at least one fastener to alternatively connect said mass resistance means to said mass resistance end of said pivoting means to perform a different selection of upper extremity exercises to maximize the operator's productivity and efficiency while the operator is provided with the range of motion and type of movement needed for daily living.

2. The exercise machine of claim 1 wherein said at least one attachment is selected from a group consisting of non-adjustable attachments, vertically adjustable attachments, horizontally adjustable attachments, L-shaped brackets, articulating brackets, attachments that are adjustable both horizontally and vertically, at least one extension and at least one bracket extendably connected to one another, and extensions and brackets extendably connected to one another using at least one locking pin.

3. The exercise machine of claim 2 wherein said horizontally adjustable attachments and said attachments that are adjustable both horizontally and vertically each comprise opposed horizontally extending ends that are adjustable into more than two positions.

4. The exercise machine of claim 1 wherein said at least one attachment is selected from a group consisting of brackets, L-shaped brackets, arms, articulating arms, extensions, handles, bars, and handgrips.

5. The exercise machine of claim 1 wherein said at least one attachment comprises an articulated arm, an extension connected to said arm, and at least one handgrip connected to said extension.

6. The exercise machine of claim 5 wherein said at least one handgrip is selected from a group consisting of bilateral handgrips, and unilateral handgrips.

7. The exercise machine of claim 5 further comprising at least one locking pin configured to securely fix said at least one handgrip to said extension.

8. The exercise machine of claim 5 wherein said extension has a plurality of holes configured for attachment of said at least one handgrip, and further comprising at least one locking pin configured to securely fix said at least one handgrip to at least one of said holes in said extension.

9. The exercise machine of claim 1 further comprising releasable clamping means between said elongated flexible means and said mass resistance means.

10. The exercise machine of claim 1 wherein said elongated flexible means comprises at least one filamentous member.

11. A portable exercise machine adapted for performing upper extremity exercise, said machine comprising:

two adjacent vertical pieces;

an opposing taller vertical piece positioned at a spaced-apart distance from said adjacent vertical pieces;

a base member means adapted to support said adjacent vertical pieces and said opposing taller vertical piece, said base member in contact with said adjacent vertical pieces and said taller vertical piece;

a pivoting member movably connected to said adjacent vertical pieces for central positioning over said base member, said pivoting member comprising a long and slender member having an operator end, configured for engagement by an operator during exercise, an opposed mass resistance end, and a central rotatable connection therebetween to said adjacent vertical pieces;

at least one attachment selectively securable to said operator end, said at least one attachment adapted for engagement by an operator for performing exercise;

a mass resistance positioned remotely from said pivoting member so that said taller vertical piece becomes located between said mass resistance and said pivoting member;

an elongated filamentous member connected between said mass resistance and said pivoting member;

a plurality of pulleys secured to said taller vertical piece and one pulley secured to said base member that are configured to guide movement of said filamentous member over said taller vertical piece as an operator applies sufficient force to said operator end of said pivoting member and thereby lift said mass resistance; and at least one fastener connected to said elongated filamentous member, said at least one fastener configured to provide an easily releasable attachment with said pivoting member, and wherein said pivoting member comprises fastener connecting means on said operator end and said mass resistance end adapted so that an operator is able to alternatively use said operator end and mass resistance end of said pivoting member to perform different upper extremity exercises, whereby when using said pivoting member to perform upper extremity exercises such as seated chest press, seated row, seated triceps pull down, and modified seated abdominal crunch exercises, the operator is able to use said at least one fastener to connect said mass resistance to said operator end of said pivoting member to perform selected upper extremity exercises and thereafter alternatively use said at least one fastener to connect said mass resistance to said mass resistance end of said pivoting member to perform a different selection of upper extremity exercises to maximize the operator's productivity and efficiency while the operator is provided with the range of motion and type of movement needed for daily living.

12. The exercise machine of claim 11 wherein said at least one attachment is selected from a group consisting of non-adjustable attachments, vertically adjustable attachments, horizontally adjustable attachments, attachments that are adjustable both horizontally and vertically, articulating attachments, brackets, L-shaped brackets, arms, articulating arms, articulating arms having a hinge joint that limits its angle to approximately 90 degrees when vertical force is applied, extensions, handles, bars, bilateral handgrips, and unilateral handgrips.

13. The exercise machine of claim 11 herein connection of said at least one attachment is accomplished with at least one locking pin and a plurality of holes configured for engagement with said at least one locking pin.

14. The exercise machine of claim 11 further comprising releasable clamping means between said elongated filamentous member and said mass resistance.

15. The exercise machine of claim 11 further comprising a pulley support member connecting a first one of said plurality of pulleys to said taller vertical piece in a position remote from said pivoting member.

16. The exercise machine of claim 15 wherein said pulley support member is fixed to said taller vertical piece at an angle of approximately 60 degrees from vertical and further comprising a second one of said plurality of pulleys directly attached to said taller vertical piece in a superior position to said first one of said plurality of pulleys attached to said support member.

* * * * *